US005558531A

United States Patent [19]

Ikeda et al.

[11] Patent Number: 5,558,531

[45] Date of Patent: Sep. 24, 1996

[54] COMBINATION TERMINAL

[75] Inventors: Tomohiro Ikeda; Kenji Tsuchiya, both of Shizuoka, Japan

[73] Assignee: Yazaki Corporation, Tokyo, Japan

[21] Appl. No.: 380,577

[22] Filed: Jan. 30, 1995

[30] Foreign Application Priority Data

Feb. 9, 1994 [JP] Japan ..... 6-015492

[51] Int. Cl.[6] ..... H01R 13/28

[52] U.S. Cl. ..... 439/287; 439/290; 439/907

[58] Field of Search ..... 439/287, 288, 439/290, 907

[56] References Cited

U.S. PATENT DOCUMENTS

| | | | |
|---|---|---|---|
| 2,497,523 | 2/1950 | Warkentin | 439/287 |
| 2,615,736 | 10/1952 | Bergan et al. | 439/287 |
| 2,713,154 | 7/1955 | Bilsborough | 439/287 |
| 3,316,522 | 4/1967 | Demler, Sr. | 439/288 |
| 3,411,127 | 11/1968 | Adams | 439/290 |
| 3,516,043 | 6/1970 | Spofford | 439/287 |
| 4,357,070 | 11/1982 | Fukushima et al. | 439/287 |
| 4,371,230 | 2/1983 | Inoue | 439/907 |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A combination terminal is provided so that it is minimally deformable. The strength of plate terminals constituting the combination terminal is maximized to ensure the prevention of both backlash and accidental disengagement. A plate terminal includes a rectangular plate-like securing member having a substantially circular securing hole in the center, and a joint having a coated clamping member consecutively extended from the end of the securing member and a conductor clamping member. The securing member is perpendicular to the length direction of the joint. The securing member is provided with retaining planes folded stepwise between base planes on opposite sides of the securing hole. The retaining planes are stepped down by the thickness of each base plane. In one end portion of the base plane is a fitting hole bored therein. In the other end portion stands a lock pawl cut downwardly corresponding to the fitting hole of a mating plate terminal.

8 Claims, 11 Drawing Sheets

COMBINATION TERMINAL

BACKGROUND OF THE INVENTION

1. Field of the Invention

The present invention relates to a combination terminal, formed with a plurality of plate terminals bound together and coupled to a plurality of electric wire terminals by pressure-welding, so that the electric wire terminals are collectively connectable in automotive equipment or the like.

2. Related Art

When a plurality of plate terminals used for automobile ground wires and the like are bound together before being coupled to one place, the conventional practice is to join securing members provided at the front ends of the respective terminals and to fix the combination to a desired portion of a car body with a bolt by concentrically superposing securing holes. Clamping members are provided at the rear ends of the respective terminals and are used for pressure-welding electric wire terminals. Since these clamping members are three-dimensional in contour, they tend to interfere with each other during the securing operation, thus making it extremely difficult to combine the plate-like securing members precisely. The drawback is that the function of the electric wire terminal may be impaired by the deformation of the base of the securing member because of its buckling, for example, and by the space produced between the securing members.

In order to obviate the aforementioned drawback, there have been proposed combination plate terminals 1M and 1N consecutively incorporating respective joints **3*m* and 3*n* as shown in FIGS. 17 and 18. It is however needed to couple electric wires 4 that have been clamped together to the respective joints 3*m* and 3*n* of the combination plate terminals 1M and 1N**. Consequently, difficult operations are required, including moving a number of set electric wire elements to a desired position and pressure-welding the plurality of electric wires to one plate terminal while arranging them in order before actually securing the terminal to equipment.

Japanese Utility Model Publication No. 12543/1988, for example, discloses a combination terminal which is intended to avoid such complicated work as noted above through the steps of coupling a plate terminal to each set electric wire element beforehand and joining two plate terminals mounted on a conveyor line instantly in the process of manufacturing set electric wires. More specifically, a plate terminal 1P comprises, as shown in FIGS. 19 and 20, a rectangular securing member **2*p* with a securing hole 5 for receiving a clamp bolt therethrough, the securing hole 5 being provided in the central part of a base plane 6*p*, and a joint 3*p* which is U-shaped in cross section, the joint 3*p* being incorporated with the securing member 2*p* and protruded outwardly. A retaining plane 7*p* is set opposite and parallel to a tongue-like retaining plane 8*p* along the longitudinal direction of the joint 3*p* with the securing hole 5 in the base plane 6*p* therebetween. The retaining planes 7*p* and 8*p* are formed so that each of them is stepped up by the thickness of the base plane 6*p*. The retaining plane 7*p* is provided with a fitting hole 9*p*, whereas the retaining plane 8*p* is provided with a lock pawl 10*p*** thereon.

As shown in FIG. 21, further, the two plate terminals 1P, 1R thus arranged are placed one upon another as shown by a chain line in such a manner as to join the securing members **2*p*, 2*r* back to back. Subsequently, the securing member 2*r* is slid in the direction of an arrow so as to superpose the retaining planes 7*p*, 8*r* of the plate terminals 1P, 1R, and the retaining planes 8*p*, 7*r* of the plate terminals 1P, 1R, respectively. Then the two plate terminals 1P, 1R are integrally combined together when the lock pawls 10*r*, 10*p* engage with the respective fitting holes 9*r*, 9*p***.

However, because plate terminal 1P has the fitting hole **9*p* bored in the retaining plane 7*p* and the lock pawl 10*p* cut upward, its strength is lowered because the sectional areas of the retaining planes 7*p*, 8*p* have been reduced. Moreover, the difference in level between the retaining planes 7*p*, 8*p* and the base plane 6*p* also results in reducing the terminal's bending strength. Consequently, there is the possibility that the retaining planes 7*p*, 8*p* and the securing member 2*p* in combination will be deformed when they are put in place. The resulting dimensional distortion may invite failure in mating the plate terminals 1P, 1R** or cause the terminals to be easily disconnected.

Since there are two places where the lock pawls mate with the respective fitting holes, there may arise a problem in that backlash ensues after the plate terminals 1P, 1R have been joined together, thus causing the terminal to be easily dislocated, for example.

Although it is preferable for the plate terminals 1P, 1R to be readily joined together with moderate force of fitting the lock pawls into the respective fitting holes, greater holding strength is desired after they have been joined together. If, however, an attempt is made to reduce the force of insertion by decreasing the size of such a-lock pawl, for example, its holding strength will be decreased. If, conversely, increasing the holding strength is attempted, the force of insertion will also need to be increased.

In some cases, a combination of applicable electric wires different having different diameters and two kinds of plate terminals having different plate thicknesses are used. In such a case, the following problem is posed.

The clamping contour of a combination terminal depends on the diameter of the electric wire; small diameter electric wires fall in a range of 0.5–2.0 $mm^2$ and large diameter electric wires fall in a range of 2.0–5.0 $mm^2$. Normally, a plate material 0.8 mm thick is uniformly used to satisfy the clamping performance of the large diameter wire. However, when the plate terminal 0.8 mm thick is used to clamp electric wires having a diameter of as small as approximately 0.5 $mm^2$, the weldability remains unstable and some of the small diameter electric wires may slip out of the plate terminal.

As shown in FIG. 22, if a plate terminal T 0.8 mm thick and a plate terminal U 0.6 mm thick are used for large- and small-diameter electric wires, spaces 23 will be formed between the base plane **6*u* of the thin-wall plate terminal U intended for the small diameter electric wires and the contact surface 21*a* of a bolt 21, and between a retaining plane 14*u* and the contact surface 22*a* of a securing member 22, respectively. Due to these spaces 23, the pressing force of the clamp bolt 21** is not transmitted smoothly and this may cause backlash and failure in preventing the electric wires from slipping out after they have been clamped.

SUMMARY OF THE INVENTION

In view of the foregoing problems, an object of the present invention is to provide a combination terminal for certainly bringing terminals into engagement with each other without causing disengagement and backlash. It is a further object of the present invention to provide a combination terminal having a plate terminal that is minimally deformable, by making the bending strength of the plate terminal as high as possible.

In order to accomplish the above and other objects, the present invention comprises a combination terminal having two plate terminals joined together, each of said plate terminals comprising a joint to which electric wires are pressure-weldable; a securing member, integrally formed with said joint, having a centrally disposed securing hole for receiving a clamp bolt and having base planes, one of said base planes being adjacent to said joint; retaining planes, extending obliquely from said base planes of said securing member, disposed on opposite sides of said securing hole; at least one lock pawl disposed on a first corner portion of one of said base planes; and at least one stepped fitting portion disposed on a second corner portion of one of said base planes, wherein said retaining planes of a first of said two plate terminals are mated with said retaining planes of a second of said two plate terminals, and said lock pawl of said first of said two plate terminals is subsequently mated with said stepped fitting portion of said second of said two plate terminals, thereby joining said two plate terminals together.

Preferably, one of the retaining planes on a given plate terminal has a substantially different width than a second of the retaining planes on the same plate terminal.

If one plate terminal is substantially thicker than the other plate terminal, the thinner plate terminal has projections disposed on one side of said second plate terminal. These projections projecting as far as the difference in thickness between the two plate terminals.

The lock pawl can be either tongue-like and lance-shaped, or can be a cut-out portion extending from the base plane.

The combination terminal according to the present invention is provided with the lock pawl or the stepped fitting portion in at least any one of the corners at the front end of the base plane, and both the retaining planes are joined before the plate terminals are mated and fixed together. Thus, the sectional area of the retaining plane is not reduced since the stepped fitting portion and the lock pawl are formed not on the retaining plane but on the base plane. Therefore, the reduction of the strength of the retaining plane is minimized.

The two plate terminals are first stacked and then one of the plate terminals is slid to join the retaining planes together. Subsequently, the lock pawls are mated with the corresponding stepped fitting portions on both sides of the plate terminals to finish fabricating the combination terminal.

The steps of joining the retaining planes of the plate terminals and mating the stepped fitting portions with the corresponding lock pawls are carried out consecutively instead of simultaneously. Therefore, deformation resulting from excessive external force can be prevented.

Moreover, the lowering of terminal strength caused by the deviation of the folding position of the base plane from that of the retaining plane can be minimized, since the longitudinal widths of the retaining planes set opposite and parallel to each other around the securing hole are different. Furthermore, an error in assembling both the retaining planes can be avoided as they are different.

In the combination terminal having two plate terminals whose plate thicknesses differ depending on the diametrical difference in the electric wires, the thin plate terminal intended for small-diameter electric wires is provided with a plurality of projections on one side of at least the base or retaining plane to ensure that the plate terminal makes contact with the faces of the bolt and the fitting member. The combination terminal can thus be secured to the fitting member without causing disengagement and backlash.

DETAILED DESCRIPTION OF THE PREFERRED EMBODIMENTS

Referring to FIGS. 1 through 14 inclusive, a detailed description will subsequently be given of a combination terminal embodying the present invention. Referring to FIGS. 1 through 4 inclusive, a first embodiment of the present invention will be described first.

Figure 1:
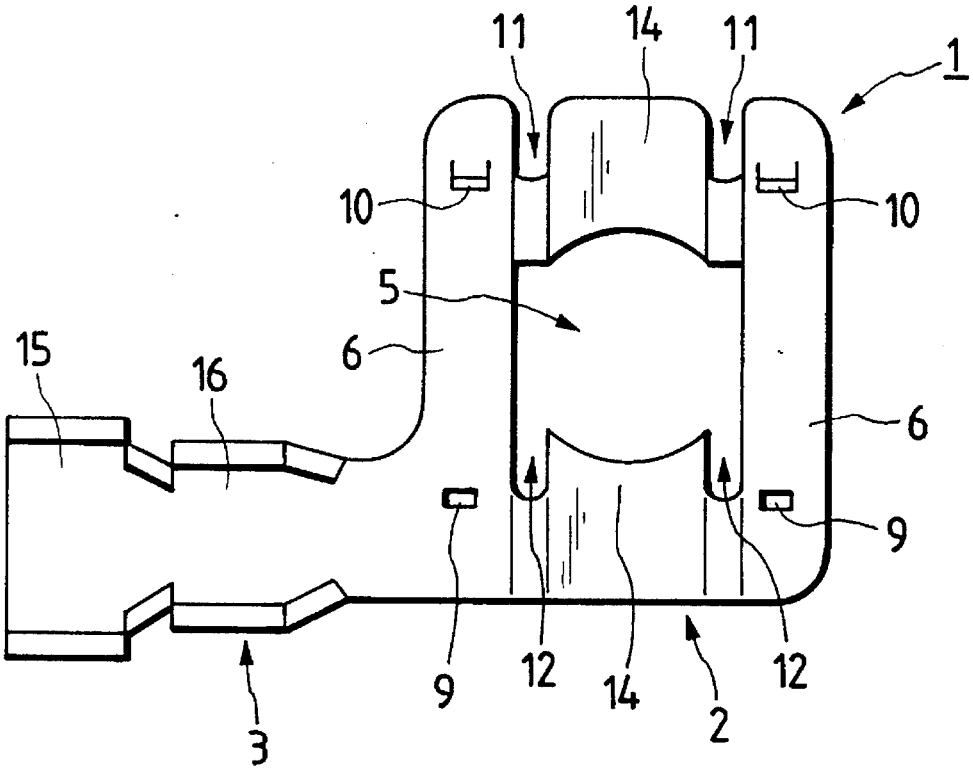
FIG. 1 is a top view of a plate terminal for use in forming a combination terminal as a first embodiment of the present invention.
Figure 2:
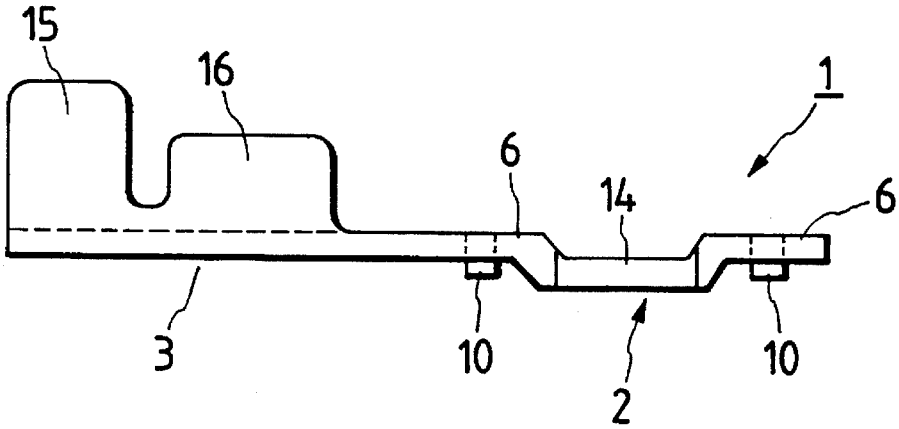
FIG. 2 is a side view of the plate terminal of FIG. 1.

As shown in FIGS. 1 and 2, a plate terminal 1 comprises a rectangular plate-like securing member 2 having a substantially circular securing hole 5 in its center, and a U-shaped electric wire joint 3 having a coated clamping member 15 and a conductor clamping member extending from one corner of the securing member 2. The securing member 2 is set perpendicular to the longitudinal direction of the electric wire joint 3. Securing member 2 is provided with retaining planes 14 between two opposing sides of base planes 6 on opposite sides of securing hole 5. The retaining planes 14 are oblique to the base planes 6. A fitting hole 9 is bored in a first end portion of each base plane 6. In the other end portion, a lock pawl 10, which is cut downward from the base plane, is projected at a position opposite the fitting hole 9. Moreover, notches 11, 12 are provided between the base planes 6 and the retaining planes 14, respectively.

Although the fitting hole 9 is a through-hole in this embodiment, it need not necessarily be such a through-hole. Instead, it may be a U-shaped stepped portion in cross section or a U-shaped cutout in top view, as long as the lock pawl 10 is allowed to engage therewith.

Figure 3:
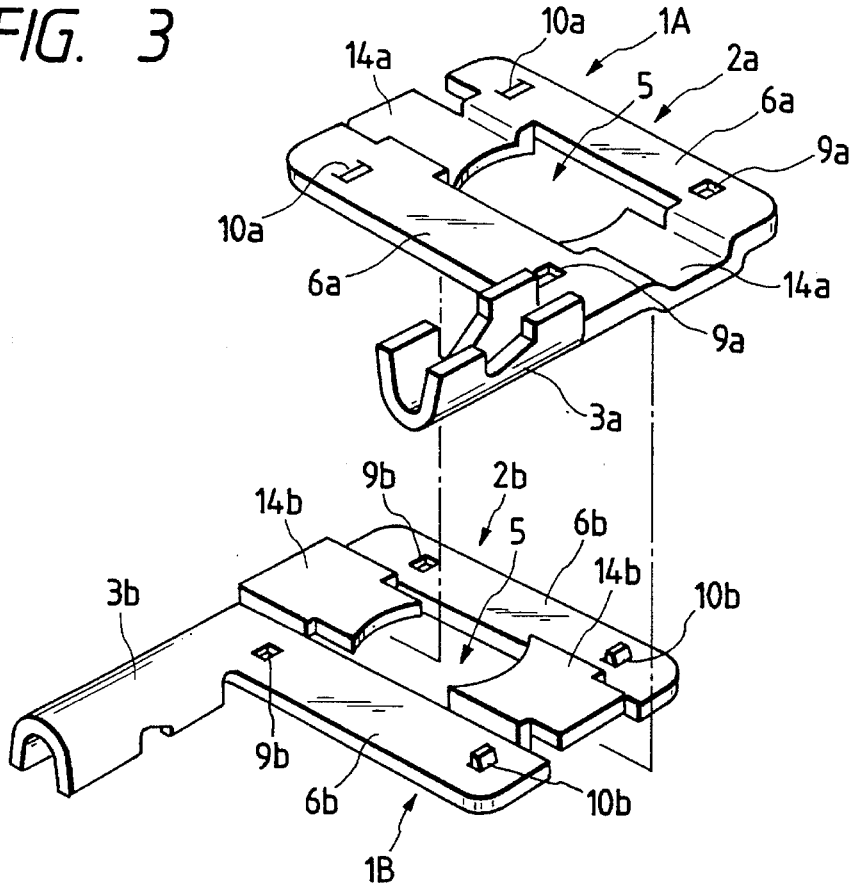
FIG. 3 is a perspective view of two plate terminals before being combined together in FIG. 1.
Figure 4:
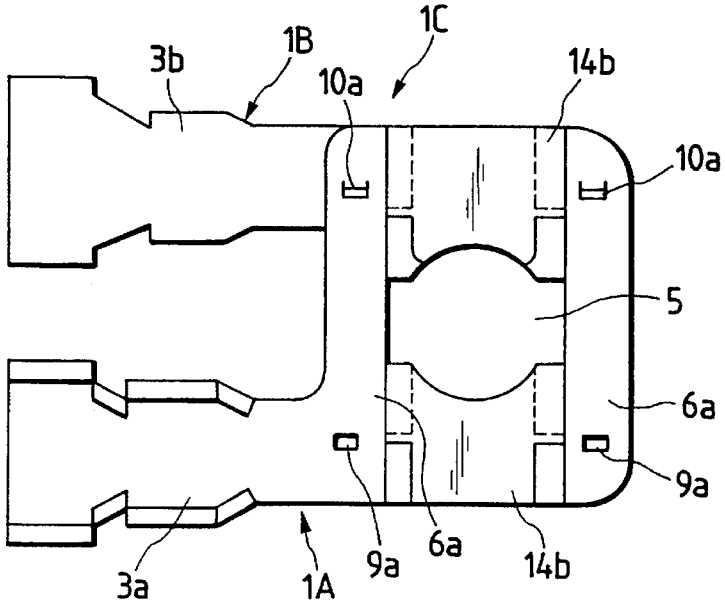
FIG. 4 is a top view of the two plate terminals after being combined together in FIG. 1.

Two plate terminals 1A, 1B are joined together as shown in FIG. 3. First, the plate terminal 1A is slid laterally along the dotted arrows of FIG. 3 so that the retaining planes 14*a* of the plate terminal 1A fit underneath the retaining planes 14*b* of the other plate terminal 1B with its back upward. The underside of the base plane 6*a* of the plate terminal 1A is joined to that of the base plane 6*b* of the plate terminal 1B with a space held therebetween, so that the plate terminals 1A and 1B are tentatively retained. Subsequently, lock pawls 10*a* on the base plane 6*a* of the plate terminal 1A engage with the respective fitting holes 9*b* of the plate terminal 1B and, simultaneously, the fitting holes 9*a* in the base plane 6*a* of the plate terminal 1A mate with the respective lock pawls 10*b* of the plate terminal 1B. The plate terminals 1A and 1B are thus combined completely as shown in FIG. 4. Consequently, the single plate terminals 1A, 1B are combined into a combination terminal 1C which has coupled two connecting electric wires by pressure-welding to electric wire joints 3*a*, 3*b*.

The combination terminal 1C thus fabricated is equipped with retaining planes 14*a*, 14*b* which possess improved strength, since the fitting holes 9*a*, 9*b* and the lock pawls 10*a*, 10 that have heretofore been provided in and on the retaining planes 14*a*, 14*b* are now provided in and on the base planes 6*a*, 6*b*, respectively. Moreover, the force of keeping the lock pawls 10*a*, 10*b* engaging with the respective fitting holes 9*a*, 9*b* is stabilized as the fitting and assembling operation is performed step by step to ensure that the combination terminal 1C is smoothly fabricated. Backlash, disengagement, and the like can thus be prevented from arising.

Although the plate terminals of the same shape and the same size have been used to constitute the combination terminal according to the first embodiment of the invention, it may be possible to provide a combination terminal which has electric wire joints directed to the same side and can dispense with arranging twisted electric wires. In the latter case, plate terminals are prepared in such a way that their joints for pressure-welding electric wires are formed in a direction opposite to what has been employed in the first embodiment of the invention, and these plate terminals can be used in combination with those in the preceding embodiment.

Referring to FIGS. 5 through 9 inclusive, a second embodiment of the present invention will be described. In these drawings, like reference characters designate component members common to those in the first embodiment and the description thereof will be omitted.

Figure 5:
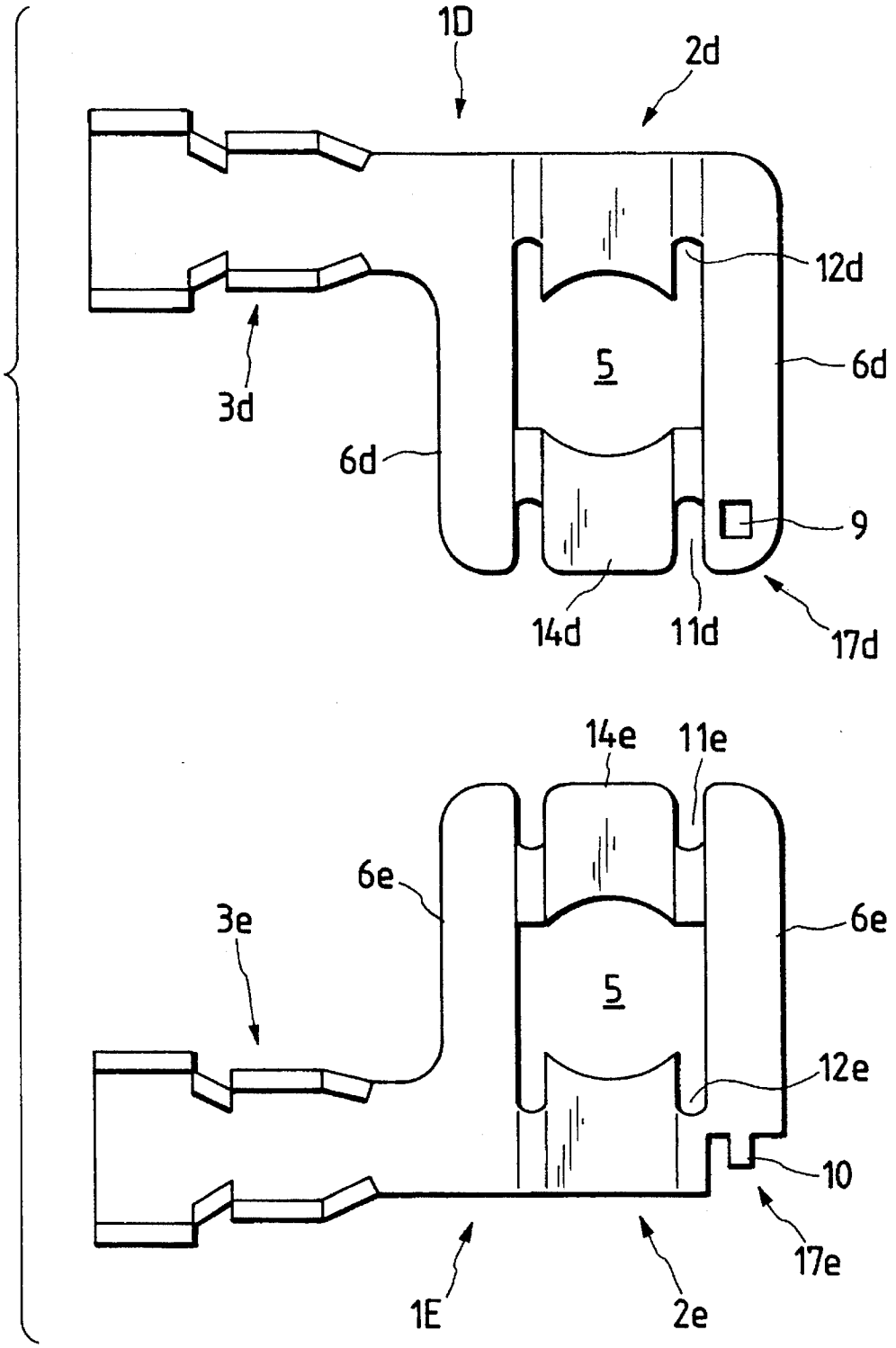
FIG. 5 is a top view of plate terminals constituting a combination terminal as a second embodiment of the present invention.
Figure 7:
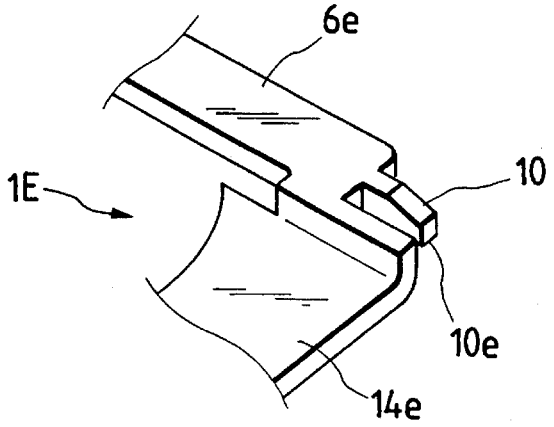
FIG. 7 is a partial enlarged view of the lock pawl of the plate terminal in FIG. 5.
Figure 8:
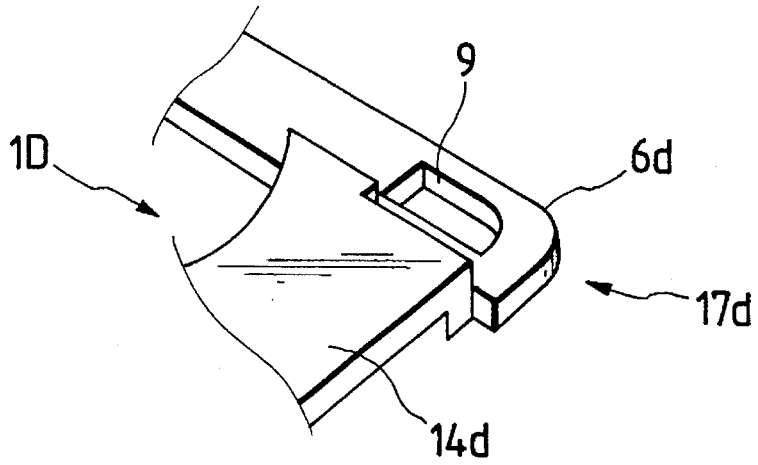
FIG. 8 is a partial enlarged view of the fitting hole of the plate terminal in FIG. 5
Figure 9:
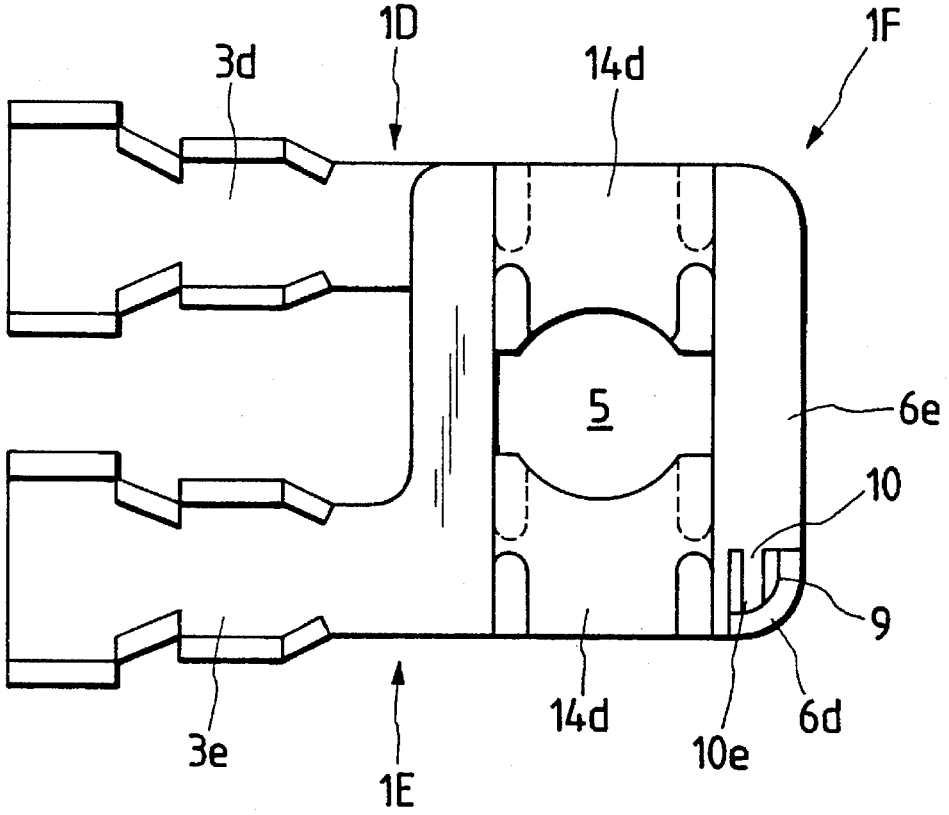
FIG. 9 is a top view of the two plate terminals after being combined together in FIG. 5.

As shown in FIG. 5, one plate terminal 1D is provided with a fitting hole 9 in one corner 17*d* at the front end of its securing member 2*d*, whereas the other plate terminal 1E is provided with a lock pawl 10 projecting from the end portion 17*e* in the direction in which a securing member 2*e* is joined to the plate terminal 1D, the lock pawl 10 being engaged with the fitting hole 9. The lock pawl 10 is, as shown in FIG. 7, tongue-like and lance-shaped and its front end portion 10*e* is curved toward the other plate terminal. Moreover, the fitting hole 9 is, as shown in FIG. 8, opened in a position corresponding to the lock pawl 10 in such a configuration as to trace the front end portion 17*d* in the direction in which the securing member 2*e* is joined to the plate terminal 1D.

Figure 6:
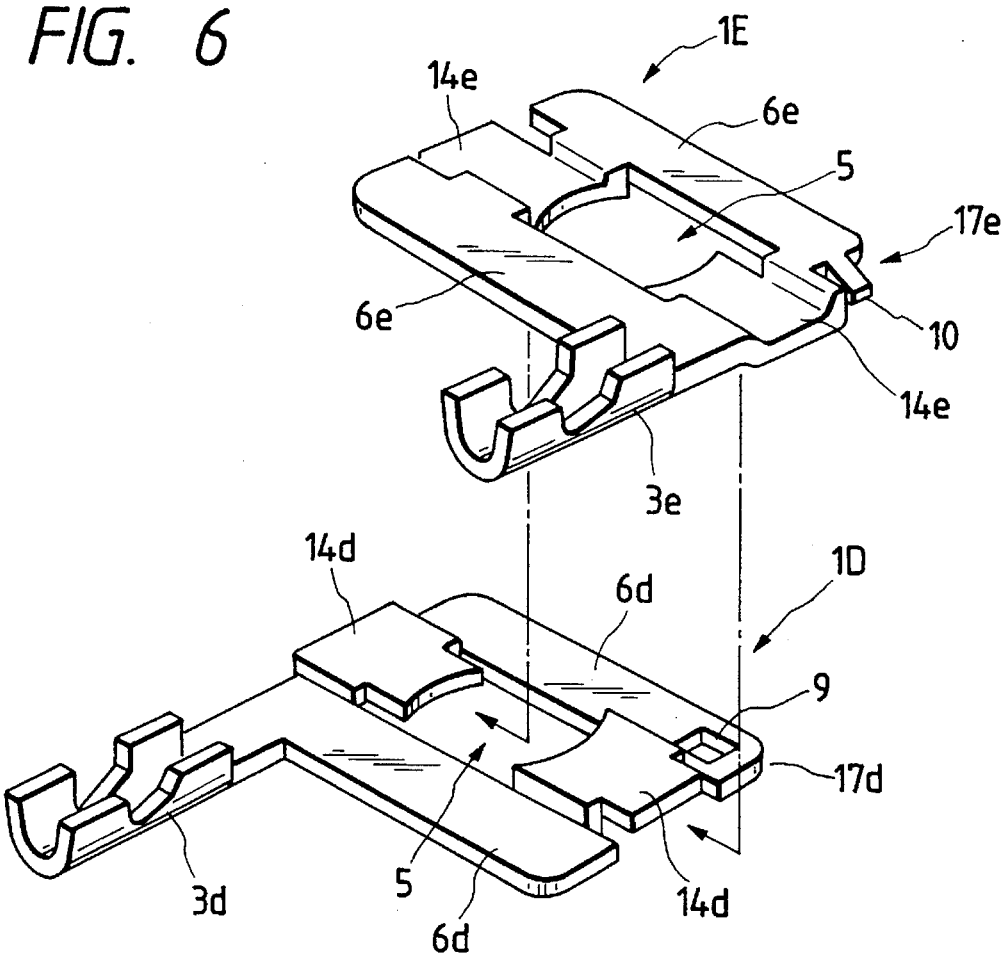
FIG. 6 is a perspective view of two plate terminals before being combined together in FIG. 5.

As shown in FIG. 6, the plate terminals are combined by sliding the plate terminal 1E laterally along the dotted arrows of FIG. 6 so that the retaining planes 14*e* of the plate terminal 1E fit underneath the retaining planes 14*d* of the other plate terminal 1D. While the underside of the base plane 6*e* of the plate terminal 1E remains in contact with the surface of the base plane 6*d* of the plate terminal 1D, the plate terminal 1E is further slid in the direction in which both plate terminals are completely superposed. In other words, the base plane 6*d* of the plate terminal 1D is relatively slid on the base plane 6*e* of the plate terminal 1E while both are kept in contact with each other. Then the front end portion 10*e* of the lock pawl 10 of the plate terminal 1E is fit into the fitting hole 9 of the plate terminal 1D and a combination terminal 1F formed of the plate terminals 1D, 1E is thus fabricated.

Consequently, the combination terminal 1F is provided with the fitting hole 9 at one place of the plate terminal 1D and the lock pawl 10 at a place corresponding to the fitting hole 9 of the plate terminal 1E, so that its strength is prevented from decreasing, unlike a case where a plurality of fitting means are provided on the plate terminals. Since the lock pawl 10 is of a flexible lance type, moreover, the plate terminals can be combined by slide-fitting with little force of insertion. In other words, the assembly work is facilitated and the resulting greater holding force prevents accidental disengagement.

Moreover, the lock pawl 10 is formed in the endmost portion in the direction in which the plate terminals are combined and to be fitted into the fitting hole 9 immediately before the assembly work is completed. This ensures that the force of insertion is decreased as the force of bending the lock pawl is not required during the assembly work.

A description has been given of the combination terminal 1F as the second embodiment of the present invention, wherein the lock pawl 10 is provided in the end portion 17*e* on the side of electric wire joint 3*e* of the base plane 6*e* at the front end of the plate terminal 1E, and the fitting hole 9 is provided correspondingly at the front end of the plate terminal 1D. As a modified example for making the same effect as in this embodiment of the invention obtainable, it is also acceptable to form a lock pawl in the end portion on the same side as the electric wire joint 3*d* and a fitting hole correspondingly provided on the front end of the plate terminal 1E.

Figure 10:
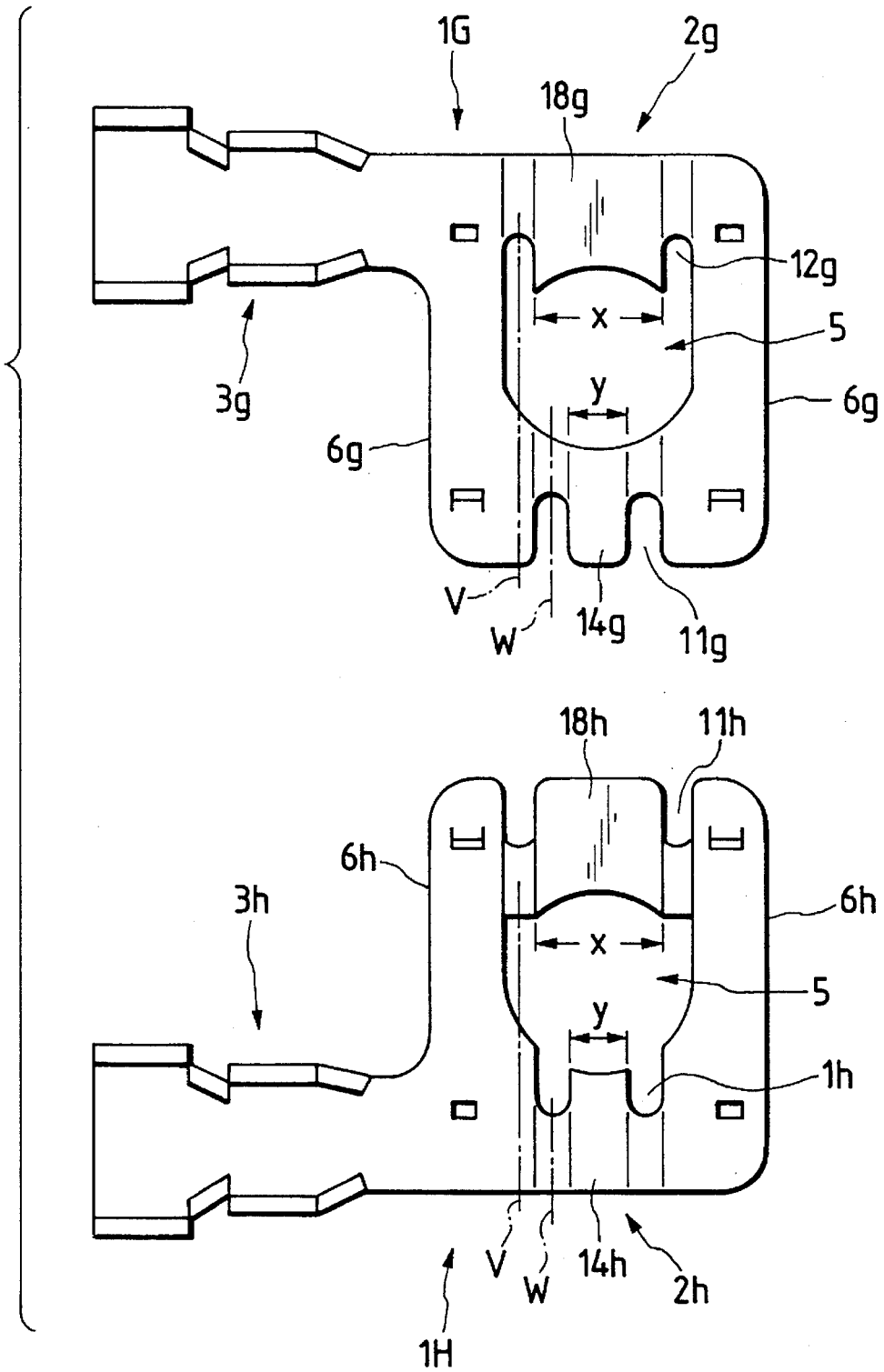
FIG. 10 is a top view of a plate terminal for use in forming a combination terminal as a third embodiment of the present invention.
Figure 11:
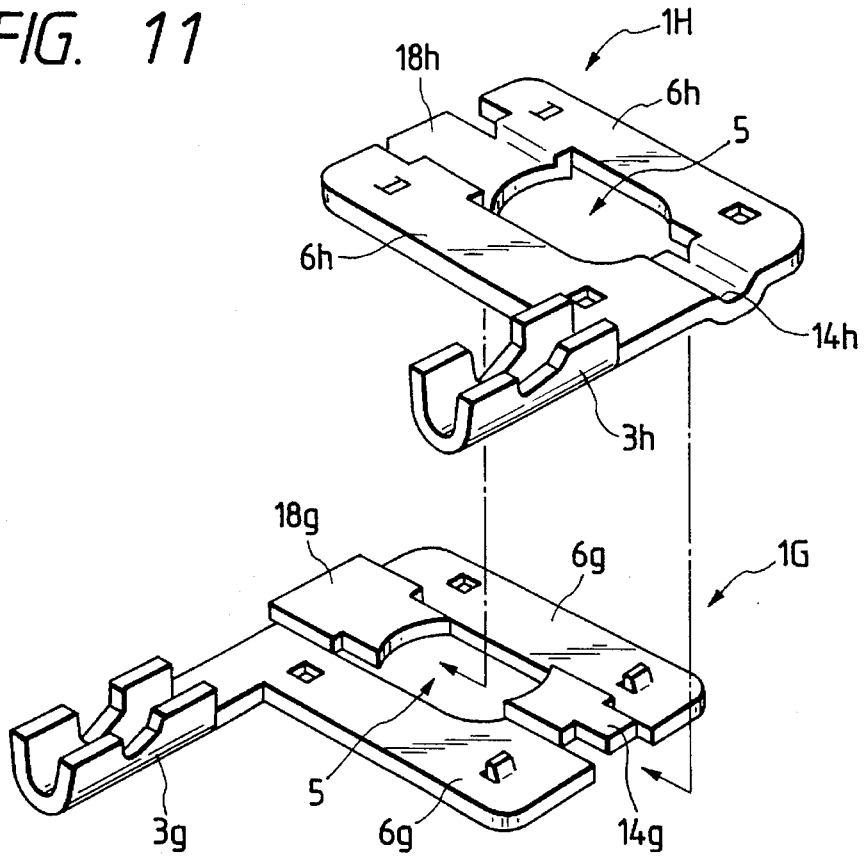
FIG. 11 is a perspective view of two plate terminals before being combined together in FIG. 10.
Figure 12:
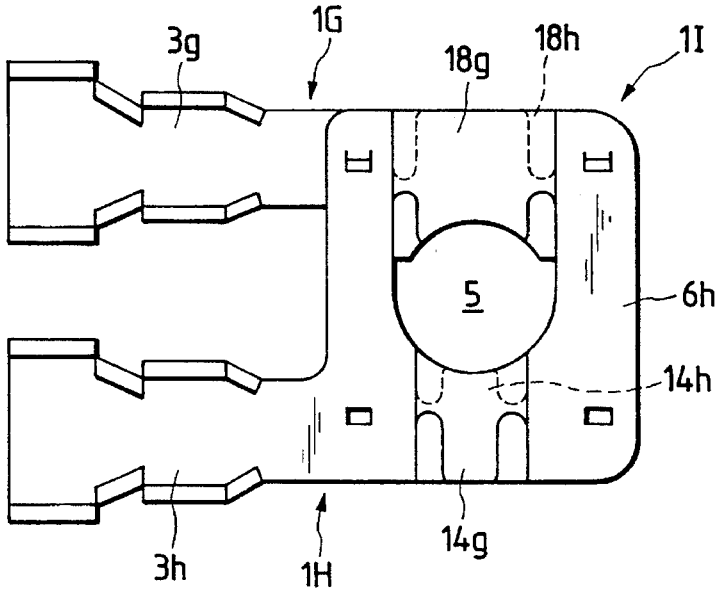
FIG. 12 is a top view of the two plate terminals after being combined together in FIG. 10.

Referring to FIGS. 10 through 12 inclusive, a third embodiment of the present invention will subsequently be described. A description of portions common to those in first and second embodiments will be omitted.

As shown in FIG. 10, plate terminals 1G, 1H in this embodiment of the invention are similar in construction to the plate terminals 1A, 1B shown in the first embodiment of the invention. However, the longitudinal widths of retaining planes set opposite and parallel to each other around the securing hole 5 on the respective plate terminals are different. More specifically, a large retaining plane 18*g* having a width of x is provided on the joint side 3*g* of the plate terminal 1G, and a small retaining plane 14*g* having a width of x is projected toward the front end side opposite to the large retaining plane 18*g*. A large retaining plane 18*h* having the same width y to be combined with the large retaining plane 18*g* is provided on the front end side of the plate terminal 1H, and a small retaining plane 14*h* having the same width Z to be combined with the small retaining plane 14*g* is provided on the joint side 3*h*.

Moreover, bent portions for use in forming the large retaining planes 18*g*, 18*h* and the small retaining planes 14*g*, 14*h* are shifted from each other on the respective plate terminals. That is, the center line v of the stepped bent portion formed to project the large retaining planes 18*g*, 18*h* with respect to base planes 6*g*, 6*h* is shifted from the center line w of the stepped bent portion formed to project the small retaining planes 14*g*, 14*h* with respect to the base planes 6*g*, 6*h* so as to prevent both the center lines from conforming to each other. Consequently, the external force applied from the joints via electric wires to the plate terminals, for example, acts in the front end direction. Since the center lines v, w of the stepped bent portions are shifted from each other, the external force is prevented from concentrating on one portion and is instead dispersed.

Although lock pawls and fitting holes are similar in construction to those shown in the first embodiment of the invention, they may be provided on and in the large retaining planes 18*g*, 18*h* and the small retaining planes 14*g*, 14*h*, respectively.

As shown in FIG. 11, the plate terminals are combined by sliding the plate terminal 1H laterally along arrows of alternate long and short dash lines of FIG. 11 in such a way that the retaining planes 14H, 18H of the plate terminal 1H fit underneath the retaining planes 14G, 18G of the other plate terminal 1G. While the underside of the base plane 6*h* of the plate terminal 1H remains in contact with the surface of the base plane 6*g* of the plate terminal 1G, the plate terminal 1H is further slid in the direction in which both plate terminals are completely superposed. In other words, the base plane 6*g* of the plate terminal 1G is relatively slid on the base plane 6*h* of the plate terminal 1H while both are kept in contact with each other.

Then the large retaining plane 18*h* of the plate terminal 1H is superposed on the underside of the large retaining plane 18*g* of the plate terminal 1G, whereas the small retaining plane 14*h* of the plate terminal 1H is superposed on the underside of the small retaining plane 14*g* of the plate terminal 1G.

Further, the lock pawls and the fitting holes of the corresponding plate terminals 1H, 1G engage with each other to complete the assembly of a combination terminal 1I comprising the plate terminals 1G, 1H.

With the provision of the large wide retaining plane and the small narrow retaining plane in such a single plate terminal, any attempt to combine plate terminals of the same type by mistake will become abortive as these plate terminals of the combination terminal 1I interfere with each other. When it is attempted to combine two plate terminals 1G, for example, since the large retaining plane 18*g* on one side interferes with the small retaining plane 14*g* on the other, both the retaining planes will fail to fit together.

Since the center line v has shifted from the center line w (as shown in FIG. 10), moreover, the external force applied from the connecting electric wires and the like is not allowed to concentrate on the stepped bent portions and the securing members are never deformed because of the external force. Therefore, the plate terminals mated together cannot be disengaged by external force such as vibration.

Figure 13:
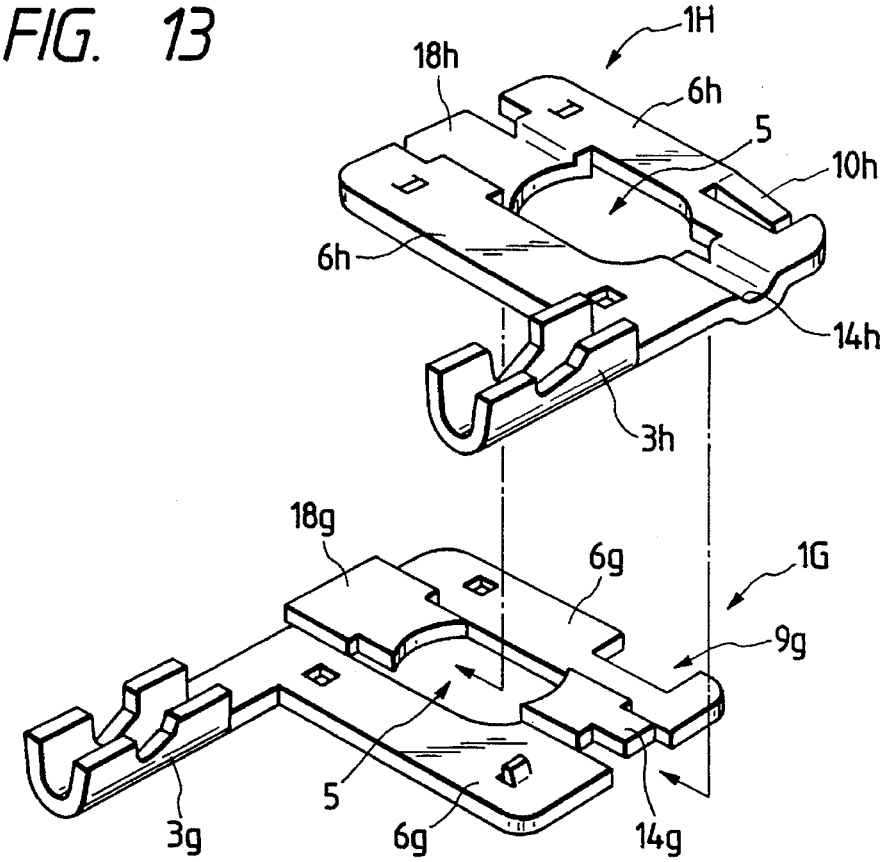
FIG. 13 is a perspective view of two plate terminals before being combined together as a modified example of the third embodiment in FIG. 10.
Figure 14:
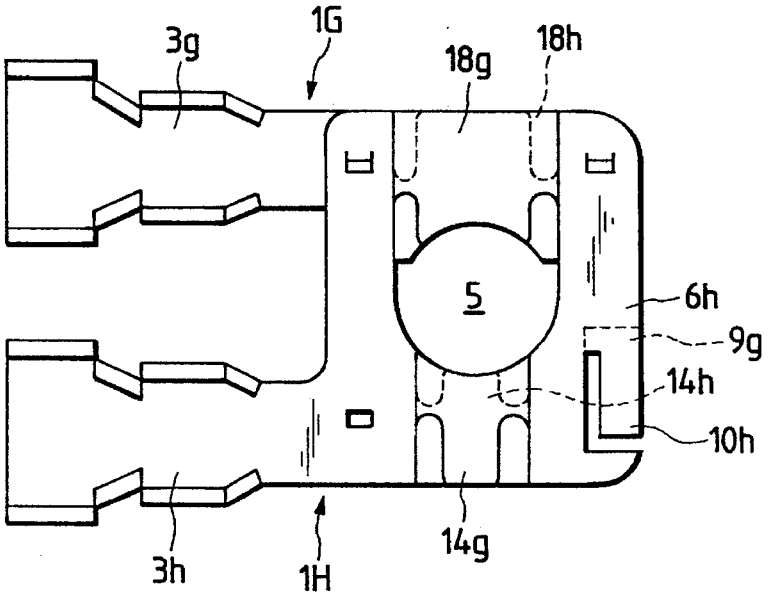
FIG. 14 is a top view of the two plate terminals after being combined together in FIG. 13.

Referring to FIGS. 13 and 14, a description will be given of a modified example as a third embodiment of the present invention.

As shown in FIG. 13, one plate terminal 1G is provided with a mating cutout 9*g* near the front end portion in the direction in which the front end of the plate terminal 1G is combined with the other plate terminal 1H. A lock pawl 10*h* is projected from the vicinity of the end portion in the direction in which the front end of the plate terminal 1H is used to engage with the cutout 9*g*. The lock pawl 10*h* is tongue-like and lance-shaped and its front end is bent toward the other plate terminal.

The plate terminal 1H is slid laterally along the dotted arrows of FIG. 13 so that the retaining planes 18*h* of the plate terminal 1H fit underneath the retaining planes 18*g* of the other plate terminal 1G to combine the plate terminals 1H, 1G together. While the underside of the base plane 6*h* of the plate terminal 1H remains in contact with the surface of the base plane 6*g* of the plate terminal 1G, the plate terminal 1H is further slid in the direction in which both plate terminals are completely superposed. Then the front end of the lock pawl 10*h* of the plate terminal 1H is caused to engage with the cutout 9*g* of the plate terminal 1G to finish combining the plate terminals 1G and 1H together.

The combination terminal thus fabricated is provided with the cutout 9*g* at one place of the plate terminal 1G and lock pawl 10*h* in the plate terminal 1H, the lock pawl 10*h* corresponding in position to the cutout 9*g*. Moreover, the width of the base planes 6*g*, 6*h* near the small retaining planes 14*g*, 14*h* is set greater than that of the base planes 6*g*, 6*h* near the large retaining planes 18*g*, 18*h*.

Therefore, the strength of the plate terminals is not reduced because of providing a plurality of securing means thereon to ensure that the plate terminals are free from deformation at the time they are combined together. Moreover, both the plate terminals can be combined by slide-fitting as the lock pawl 10*h* is of a flexible lance type, which not only improves the assembly work but also assures greater holding force resistant to disengagement.

Moreover, the lock pawl 10 is formed in the endmost portion in the direction in which the plate terminals are combined and to be fitted into the fitting hole 9 immediately before the assembly work is completed, so that the force of insertion is decreased as the force of bending the lock pawl is not required during the assembly work.

Figure 15:
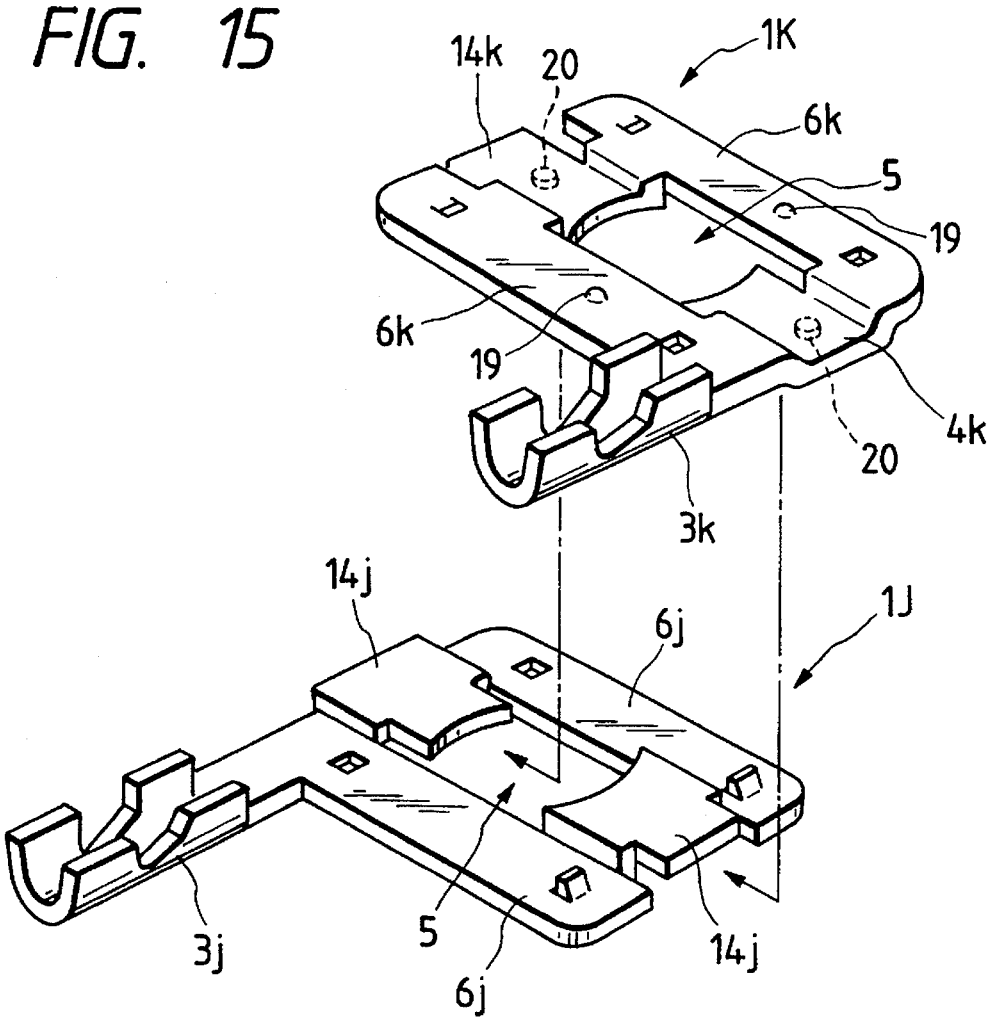
FIG. 15 is a perspective view of plate terminals before being combined together as those constituting a combination terminal in a fourth embodiment of the present invention.
Figure 16:
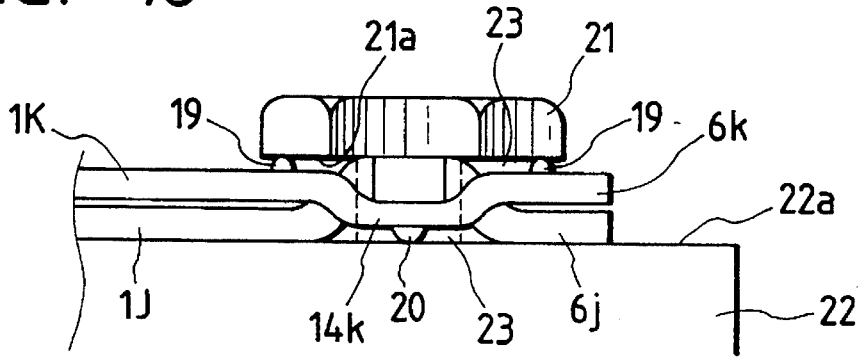
FIG. 16 is a side view of the combination terminal of FIG. 15 fixed with a bolt.
Figure 17:
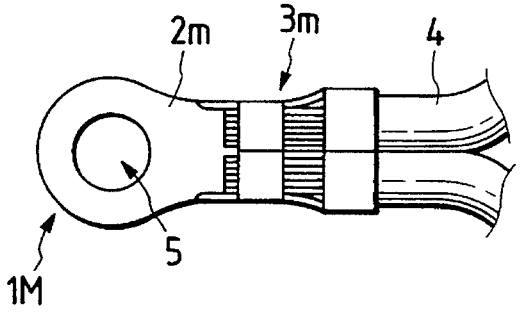
FIG. 17 is a top view of a conventional plate terminal shown as a first example.
Figure 18:
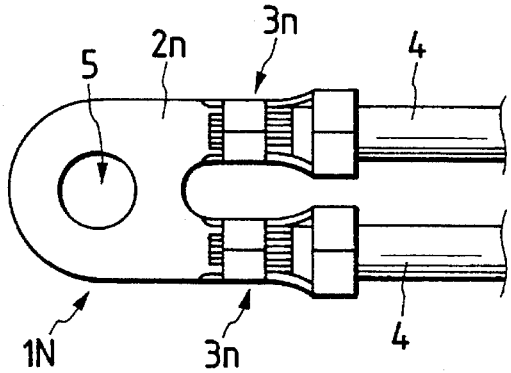
FIG. 18 is a top view of a conventional plate terminal shown as a second example.
Figure 19:
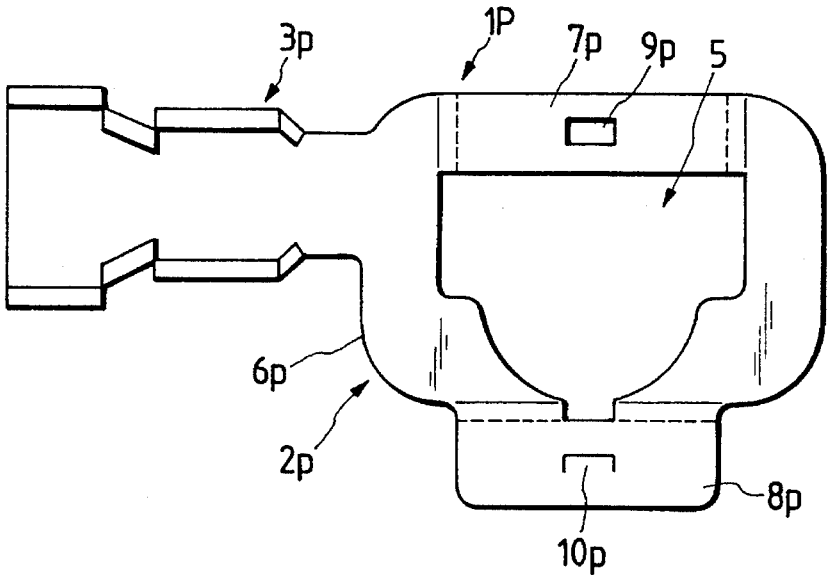
FIG. 19 is a top view of a plate terminal for use in forming a conventional combination terminal.
Figure 20:
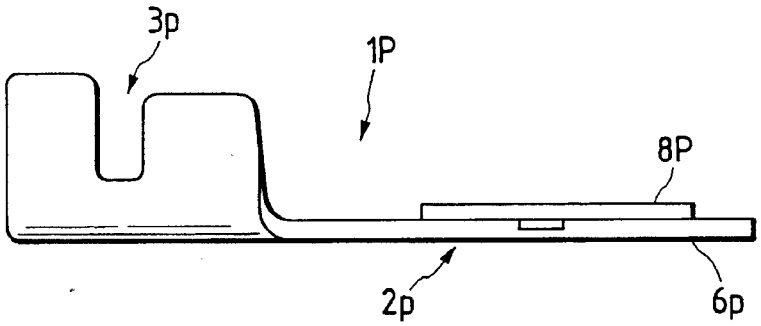
FIG. 20 is a side view of the plate terminal in FIG. 19.
Figure 21:
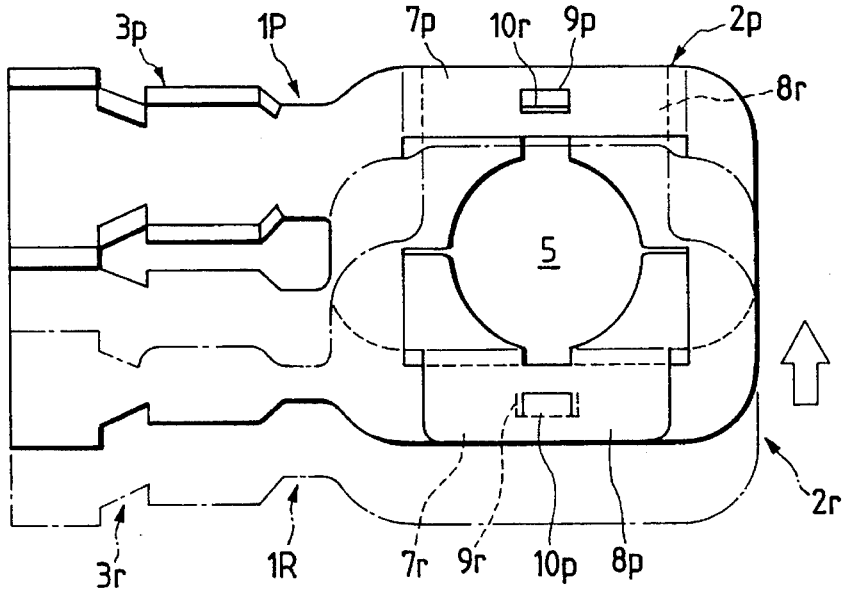
FIG. 21 is a top view of the fabricated combination terminal in FIG. 19.
Figure 22:
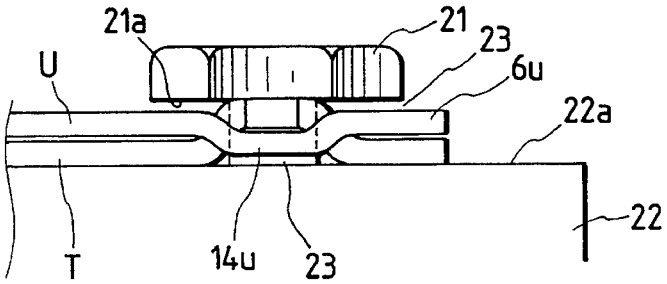
FIG. 22 is a side view of a conventional combination terminal formed with plate terminals different in thickness and fixed with a bolt.

Referring to FIGS. 15 and 16, a fourth embodiment of the present invention will subsequently be described. This embodiment of the present invention may be applicable to the first through third embodiments thereof and a description of portions common to those in first and second embodiments will be omitted.

As shown in FIG. 15, a thick-walled plate terminal 1J for large-diameter electric wires and a thin-walled plate terminal 1K are combined into a combination terminal. A plurality of projections 19 are provided on the surfaces of the base planes 6*k* of the thin-walled plate terminal 1K and a plurality of projections 10 are also provided on the undersides of retaining planes 14*k*.

Consequently, the plate terminals 1J, 1K are combined together by sliding the base planes 6*k* of the plate terminal 1K on the base planes 6*j* of the plate terminal 1J along arrows of alternate long and short dash lines of FIG. 15 in such a way that the retaining planes 14*k* of the plate terminal 1K fit underneath the retaining planes 14*j* of the other plate terminal 1J while both the base planes remain in contact with each other. Then the combination terminal finished by engaging the lock pawls of the plate terminals 1J, 1K with the corresponding fitting holes thereof is fixed to a fitting member 22 with a clamp bolt 21.

At this time, the projection 19 provided on the surface of the base plane 6*k* abuts against the contact face 21*a* of the bolt 21, whereas the projection 20 provided on the underside of the retaining plane 14*k* abuts against the contact face 22*a* of the fitting member 22.

When the plate terminals 1J, 1K are set 0.8 mm and 0.6 mm thick, respectively, for example, there is produced a space 23 of 0.2 mm between the base planes 6*k* of the plate terminal 1K and the contact face 21*a* of the bolt 21. In addition, there is also produced a space 23 of 0.2 mm between the retaining planes 14*k* of the plate terminal 1K and the contact face 22*a* of the fitting member 22.

It is therefore ensured by setting the height of the projections 19, 20 at 0.2 mm that the base planes 6*k* of the plate terminal 1K and the contact face 21*a* of the bolt 21 contact each other, and so do the retaining planes 14*k* of the plate terminal 1K and the contact face 22*a* of the fitting member 22.

Consequently, the pressing force of the clamp bolt 21 acts on the plate terminals 1J, 1K to assure that backlash and disengagement are prevented after both the plate terminals have been clamped together.

As set forth above, the combination terminals according to the present invention have the following effects.

The lock pawl or the stepped fitting portion is provided in at least any one of the corners at the front end of the base plane, and both the retaining planes are joined before the plate terminals are mated and fixed together. The provision of the stepped fitting portions and the lock pawls on the base planes contributes to increasing the strength of the retaining planes. Moreover, the steps of fitting and assembling are performed consecutively to ensure that the stepped fitting portions and the lock pawls are engaged by slide-fitting with less force of insertion. Therefore, the assembly work is improved, and both backlash and disengagement caused by the deformation of the plate terminals are prevented. A combination terminal having greater holding force can thus be provided.

In addition, the widths of the retaining planes set opposite and parallel to each other around the securing hole of the plate terminal can be relatively different. The deviation of the folding position of the base plane from that of retaining plane prevents external force from concentrating on the folded stepped portion. Consequently, the securing member is not deformed by the external force and the disengagement of the plate terminals is prevented. Further, an error in assembling the wrong terminals to one another is surely avoided as the widths of the retaining planes on the plate terminals are different.

In the case where the two plate terminals have different plate thicknesses differs because of a diametrical difference in the electric wires, the thin plate terminal intended for small-diameter electric wires has a plurality of projections on one side of at least the base or retaining plane. Therefore, the combination terminal can be fixed to the fitting member since it is ensured that the base planes of the plate terminal contact the bolt face and that the retaining planes of the plate terminal contact the surface of the fitting member.

What is claimed is:

1. A combination terminal having two plate terminals joined together, each of said plate terminals comprising:

a joint to which electric wires are pressure-weldable;

a securing member, integrally formed with said joint, having a centrally disposed securing hole for receiving a clamp bolt and having base planes, one of said base planes being adjacent to said joint;

retaining planes, extending obliquely from said base planes of said securing member, disposed on opposite sides of said securing hole;

at least one lock pawl disposed on a first corner portion of one of said base planes; and at least one stepped fitting portion disposed on a second corner portion of one of said base planes, wherein said retaining planes of a first of said two plate terminals are mated with said retaining planes of a second of said two plate terminals, and said lock pawl of said first of said two plate terminals is subsequently mated with said stepped fitting portion of said second of said two plate terminals, thereby joining said two plate terminals together.

2. A combination terminal having two plate terminals according to claim 1, wherein a first of said retaining planes on a given plate terminal has a substantially different width than a second of said retaining planes on said given plate terminal, so that a folding position of said base planes differs from a folding position of said retaining planes.

3. A combination terminal having two plate terminals according to claim 1, wherein said first plate terminal is substantially thicker than said second plate terminal, said second plate terminal having projections disposed on one side of said second plate terminal, said projections projecting as far as a thickness differential between said first and second plate terminals.

4. A combination terminal having two plate terminals according to claim 2, wherein said first plate terminal is substantially thicker than said second plate terminal, said second plate terminal having projections disposed on one side of said second plate terminal, said projections projecting as far as a thickness differential between said first and second plate terminals.

5. A combination terminal having two plate terminals according to claim 1, wherein said lock pawl is tongue-like and lance-shaped.

6. A combination terminal having two plate terminals according to claim 2, wherein said lock pawl is tongue-like and lance-shaped.

7. A combination terminal having two plate terminals according to claim 3, wherein said lock pawl is tongue-like and lance-shaped.

8. A combination terminal having two plate terminals according to claim 4, wherein said lock pawl is tongue-like and lance-shaped.

* * * * *